United States Patent [19]

Abthoff et al.

[11] 4,167,167

[45] Sep. 11, 1979

[54] INTERNAL COMBUSTION ENGINE WITH EXTERNALLY CONTROLLED IGNITION

[75] Inventors: Jörg Abthoff, Plüderhausen; Hans-Dieter Schuster, Schorndorf; Dag-Harald Hüttebräucker, Weinstadt; Reiner Kreeb; Marijan Laszlo, both of Stuttgart, all of Fed. Rep. of Germany

[73] Assignee: Daimler-Benz Aktiengesellschaft, Fed. Rep. of Germany

[21] Appl. No.: 673,137

[22] Filed: Apr. 2, 1976

[30] Foreign Application Priority Data

Apr. 3, 1975 [DE] Fed. Rep. of Germany ..... 2514483

[51] Int. Cl. ..... F02m 39/00

[52] U.S. Cl. ..... 123/139 ST; 123/139 AW; 123/179 G; 123/179 L

[58] Field of Search ..... 123/139 AW, 139 ST, 123/179 G, 179 L

[56] References Cited

U.S. PATENT DOCUMENTS

| | | | |
|---|---|---|---|
| 3,730,155 | 5/1973 | Knapp | 123/139 AW |
| 3,835,828 | 9/1974 | Knapp | 123/139 AW |
| 3,894,523 | 7/1975 | Stumpp | 123/139 AW |
| 3,974,811 | 8/1976 | Stumpp et al. | 123/139 AW |
| 3,981,288 | 9/1976 | Wessel | 123/139 AW |
| 3,993,034 | 11/1976 | Passera et al. | 123/139 AW |

*Primary Examiner*—Martin P. Schwadron
*Assistant Examiner*—G. L. Walton
*Attorney, Agent, or Firm*—Craig and Antonelli

[57] ABSTRACT

An internal combustion engine with applied ignition, preferably with a warm-up controller for a continuously operating fuel injection, in which the control pressure of the fuel injection is discontinuously controllable in dependence on different parameters with one or several jumps in the characteristic curve.

23 Claims, 18 Drawing Figures

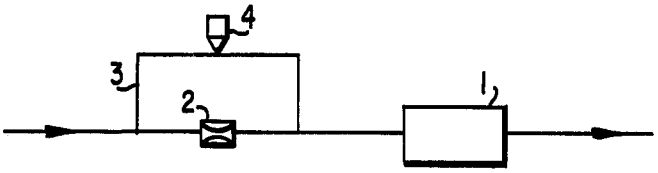
FIG. 7
FIG. 8
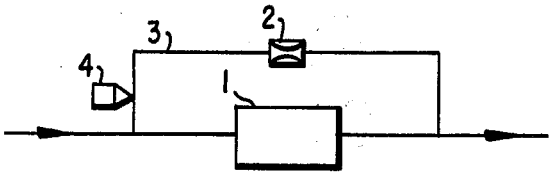
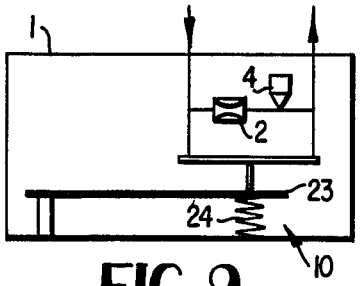
FIG. 9
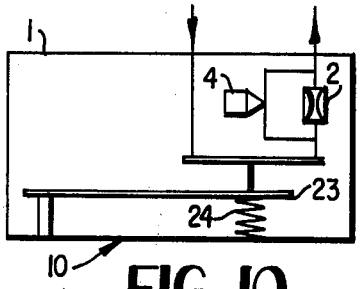
FIG. 10
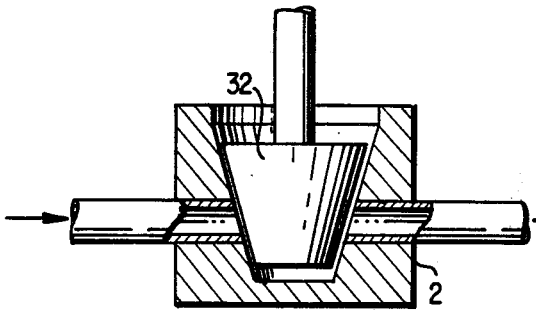
FIG. 11
FIG. 12
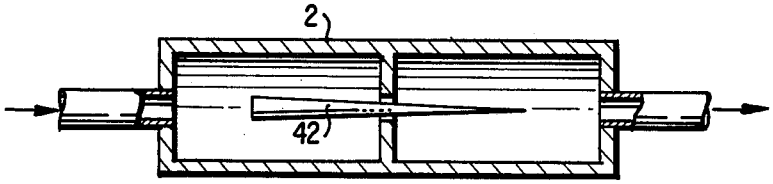

INTERNAL COMBUSTION ENGINE WITH EXTERNALLY CONTROLLED IGNITION

The present invention relates to an internal combustion engine with externally controlled or applied ignition, preferably with an engine warm-up controller, for a continuously operating fuel injection to improve the exhaust gas emission during the warm-up phase.

The aim of the present invention is to match the mixture of an internal combustion engine with externally controlled or applied ignition having a continuously operating fuel injection during the warm-up phase for improving the exhaust gas emission.

It is known that for achieving a completely satisfactory starting of internal combustion engines, an enrichment of the fuel-air mixture is necessary. The degree of this enrichment depends, primarily, on the temperatures which may reach down to −30° C., at which the engines are to be started. The base enrichment of the mixture adjusted during the cold start is gradually decreased to the required air-fuel ratio which is necessary when the engine operates under hot running conditions by way of a temperature- or time-control with a gradually warming-up engine.

In engines with continuously operating fuel injection, this adjustment takes place by a valve, the so-called warm-up controller, influenced by the control pressure and controlled by a bi-metal. This warm-up controller acts on the control pressure as a throttle variable over the warm-up period, which control pressure again correlates with the air-fuel ratio with a predetermined pressure flap or valve position in an air-quantity measuring device. By reason of the selection of the parts of the warm-up controller, namely, of the bi-metal spring, of the counter-spring, of the valve cross section, of the valve cone and of the heater coil, a continuous control pressure curve results which may be linear, degressive or progressive as a function of time or engine temperature.

In contradistinction to the cold start, only a portion of the warm-up characteristic, namely, of that from 20° C. upward is of interest for the exhaust gas emission. This range of the warm-up, however, is linked directly to the characteristic curve and to the base adjustment of the warm-up controller and cannot be varied independently of the cold start in the heretofore known types of controllers.

It is the aim of the present invention to avoid these disadvantages and to subdivide the warm-up into phases independent of one another.

The underlying problems are solved according to the present invention in that the control pressure of the fuel injection is controllable discontinuously in dependence on different parameters with one or several jumps in the characteristic curve.

As a result thereof, the warm-up is subdivided into mutually independent phases so that in practice for the range of the exhaust gas emission test methods of interest, a changed control pressure curve having a jump function subdivided at will can be determined. In connection therewith, provision may additionally be made that any desired jump function of the control pressure is adjustable ahead of or in the warm-up transmitter by the installation of at least one throttle which can be selectively turned-on or off as a function of load, temperature or time, depending on the requirement. This throttle according to a further feature of the present invention may be so constructed that a valve slide member with several bores of different cross section is provided, whereby the respectively desired control pressure can be adjusted by the displacement of the valve slide member. The throttle, however, may also be provided as a cone-valve 32 or as a needle-valve 42 with different steps.

A by-pass line may also be provided in parallel to the throttle, which is adapted to be interconnected in order to by-pass the throttle. Also a valve may be arranged in this by-pass line. By the use of different individual controllable throttles in series one behind the other or of a valve slide member with several bores, one may dispense altogether with the warm-up controller. However, the throttles may also be interconnected ahead of the warm-up controller. As a result thereof, the pressure peaks in the warm-up controller which occur when the pressure valve strikes back can be damped.

Furthermore, the valve arranged in the warm-up controller may be provided with steps which produce a stepwise change of the throttle cross section during the adjustment of the valve. A change of the valve stroke in the warm-up controller can be attained by an external engagement preferably by a solenoid magnet.

As to the rest, it is possible that different control pressure values are adjusted independently of the base adjustment and of the running-up period.

Accordingly, it is an object of the present invention to provide an internal combustion engine with applied ignition which avoids by simple means the aforementioned shortcomings and drawbacks encountered in the prior art.

Another object of the present invention resides in an internal combustion engine with externally applied ignition in which the mixture is matched during the warm-up phase of the engine operating with a continuous fuel injection, for purposes of improving the exhaust gas emission.

Still a further object of the present invention resides in an internal combustion engine with applied ignition in which the range of the warm-up can be varied independently of the cold start.

Still another object of the present invention resides in an internal combustion engine with applied ignition in which the warm-up can be subdivided into phases that are independent of one another.

A further object of the present invention resides in an internal combustion engine with applied ignition in which a variable control pressure curve with jump functions selected at will can be predetermined for the range of the exhaust gas emission test procedure of interest.

Still another object of the present invention resides in an internal combustion engine with applied ignition which is simple in construction, avoids the need for numerous costly parts and is reliable in operation.

These and other objects, features and advantages of the present invention will become more apparent from the following description when taken in connection with the accompanying drawing which shows, for purposes of illustration only, several embodiments in accordance with the present invention, and wherein:

FIG. 7 is a schematic view of a warm-up controller in accordance with the present invention with a throttle in front of the warm-up controller and with a valve arranged in a by-pass;

FIG. 8 is a schematic view of a warm-up controller in accordance with the present invention with a throttle in parallel with the warm-up controller and with a valve arranged in a by-pass containing the throttle;

FIG. 9 is a schematic view of a warm-up controller in accordance with the present invention with a throttle operatively connected inside the warm-up controller and with a valve arranged in a by-pass;

FIG. 10 is a schematic view of a modified embodiment of a warm-up controller in accordance with the present invention corresponding to FIG. 9;

FIG. 11 is a schematic partial corss-sectional view through a cone-valve for use in the system according to the present invention;

FIG. 12 is a schematic partial cross-sectional view through a pin valve for use in the system according to the present invention;

Figure 1:
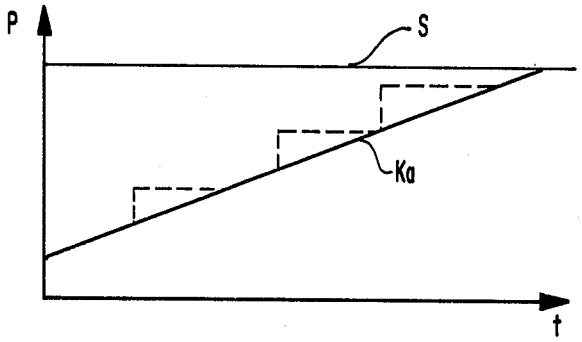
FIG. 1 is a schematic diagram illustrating the prior art characteristic curve $K_a$, in which control pressure p is plotted as a function of time t.
Figure 2:
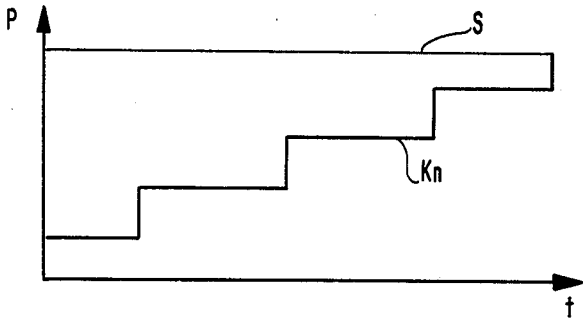
FIG. 2 is a schematic diagram of the characteristic curve $K_n$ corresponding to FIG. 1 and according to the present invention.

Referring now to the drawing, and more particularly to FIG. 1, in the diagram illustrated in FIG. 1, the control pressure p is plotted as ordinate and the time t as abscissa. The line S indicates the control pressure which is to be maintained when reaching the desired temperature after the warm-up phase. As to the rest, in the diagram of FIG. 1 the line $K_a$ is drawn-in as the old characteristic curve which is established in the heretofore used warm-up controllers. This characteristic curve $K_a$ is to be changed as indicated by the dashed line in FIG. 1, and as a result of this change is to receive approximately the shape indicated in FIG. 2 and designated therein by $K_n$ which represents the new characteristic curve in accordance with the present invention. This characteristic curve $K_n$ therefore shows that from the starting point in the course of the warm-up period, the control pressure is increased stepwise until the control pressure S is attained after the warm-up period.

Figure 3:
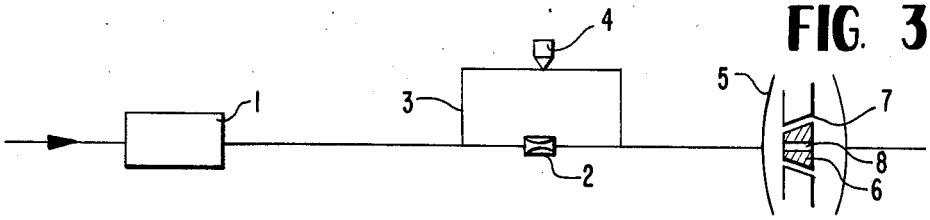
FIG. 3 is a schematic view of a warm-up controller in accordance with the present invention provided with a throttle following the warm-up controller and a valve arranged in a by-pass.

A warm-up controller 1 of conventional construction is illustrated schematically in FIG. 3 which is followed by a throttle 2. The throttle 2 can be by-passed by means of a by-pass line 3. A valve 4 is interconnected in this by-pass line 3.

In the alternative, the valve 4 and the throttle 2, however, may also be constructed together so that a corresponding valve may have the schematically illustrated configuration designated by reference numeral 5 in FIG. 3. A conical valve 6 is thereby seated in a corresponding valve seat 7 and can be lifted off from the valve seat 7. A relatively small bore 8 is provided in the conical valve which represents the throttle.

Figure 4:
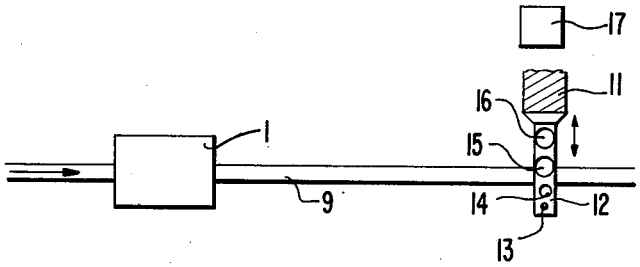
FIG. 4 is a schematic view of a modified embodiment in accordance with the present invention of a warm-up controller and of a throttle slide valve member having openings of different sizes.

A schematic warm-up controller 1 of conventional type is again illustrated in FIG. 4. A slide valve 11 is interconnected in a line 9 following the warm-up controller 1, whose slide member 12 is provided with bores 13 to 16 of differently large diameters. The slide valve 11 can be adjusted by a solenoid 17 which, depending on the applied voltage, so displaces the slide valve member 12 that one of the openings 13 to 16 opens up the passage in the line 9.

Figure 5:
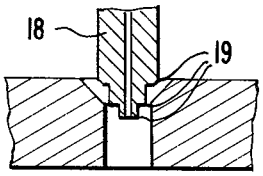
FIG. 5 is a schematic partial cross-sectional view through a stepped throttle valve for use in the system according to the present invention.

However, a valve 18 may also be provided with steps 19, as illustrated in FIG. 5, which produce the desired gradations in connection with the adjustment of the control pressure.

Figure 6:
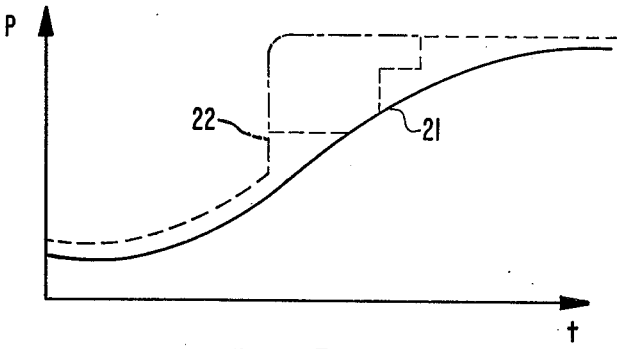
FIG. 6 is a schematic pressure-time diagram illustrating characteristic curves.
Figure 13:
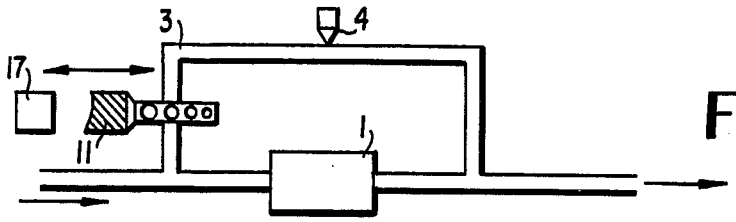
FIG. 13 is a schematic view of a warm-up controller in accordance with the present invention with a throttle slide valve member in parallel with the warm-up controller and with a valve arranged in a by-pass containing the throttle slide valve member.
Figure 14:
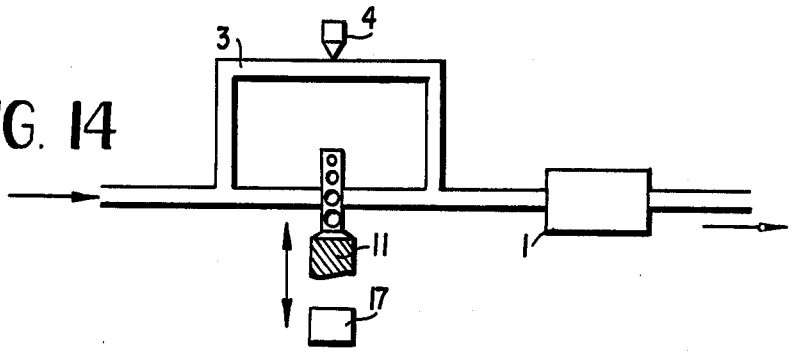
FIG. 14 is a schematic view of a warm-up controller in accordance with the present invention with a throttle slide valve member in front of the warm-up controller and with a valve arranged in a by-pass.
Figure 15:
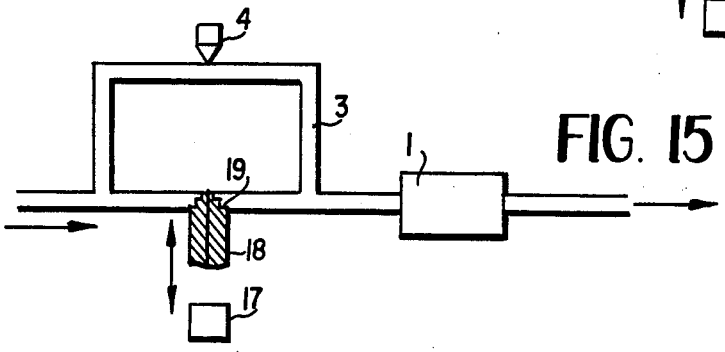
FIG. 15 is a schematic view of a warm-up controller in accordance with the present invention with a stepped throttle valve in front of the warm-up controller and with a valve arranged in a by-pass.
Figure 16:
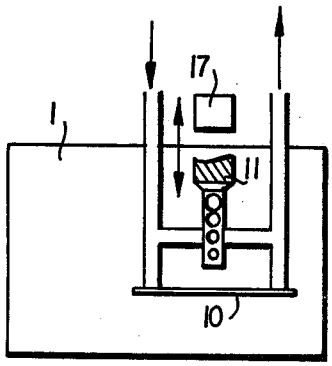
FIG. 16 is a schematic view of a warm-up controller in accordance with the present invention with a throttle slide valve member operatively connected inside the warm-up controller.
Figure 17:
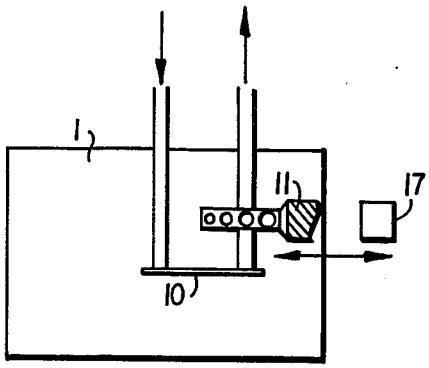
FIG. 17 is a schematic view of a modified embodiment of a warm-up controller in accordance with the present invention corresponding to FIG. 16.
Figure 18:
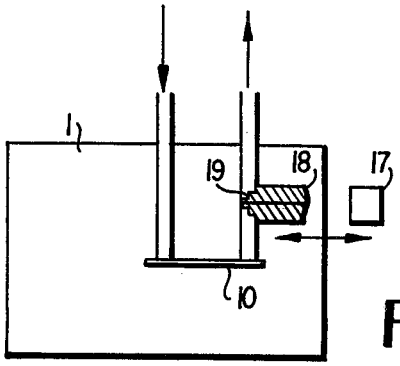
FIG. 18 is a schematic view of a warm-up controller in accordance with the present invention with a stepped throttle valve operatively connected inside the warm-up controller.

In FIG. 6 a new characteristic curve 22 illustrated in dash lines is compared to an old characteristic curve 21 shown in full line. The new characteristic curve 22 can be readily obtained by a solenoid. Since an external inter-engagement exists as a result thereof, the point of time of the jump function can be selected independently of other influences.

While we have shown and described several embodiments in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. An internal combustion engine with applied ignition and fuel injection means for improving the exhaust gas emission during the warm-up of the engine, characterized by means for subdividing the warm-up phase of the engine into mutually independent nonnegative phases, said subdividing means including an independently adjustable control means for discontinuously controlling the control pressure of the fuel injection means in dependence on at least one different parameter and for producing only positive jumps in the characteristic curve thereof.

2. An internal combustion engine according to claim 1, characterized in that the characteristic curve has more than one.

3. An internal combustion engine according to claim 2, characterized by a throttle means operatively connected with the warm-up controller means, said throttle means being operable to be selectively turned on and off and being operable to produce a desired jump function of the control pressure.

4. An internal combustion engine according to claim 3, characterized in that the throttle means is interconnected ahead of the warm-up controller means.

5. An internal combustion engine according to claim 3, characterized in that the throttle means is operatively connected in the warm-up controller means.

6. An internal combustion engine according to claim 3, characterized in that the throttle means is operatively connected downstream of the warm-up controller means.

7. An internal combustion engine according to claim 3, characterized in that the throttle means is operable to be selectively turned on and off in dependence on at least one of load, temperature and time.

8. An internal combustion engine according to claim 1, characterized by a warm-up controller means for a continuously operating fuel-injection means.

9. An internal combustion engine according to claim 8, characterized in that a valve means is provided in the warm-up controller means, said valve means having steps which, upon adjustment of the valve means produce a stepwise change of the throttle cross section.

10. An internal combustion engine according to claim 9, characterized in that a change of the valve stroke in the warm-up controller means is attained by external means.

11. An internal combustion engine according to claim 10, characterized in that the external means includes a solenoid.

12. An internal combustion engine with applied ignition and fuel injection means for improving the exhaust gas emission during the warm-up phase of the engine, characterized by means for subdividing the warm-up phase of the engine into mutually independent nonnegative phases, said subdividing means including control means for discontinuously controlling the control pressure of the fuel injection means in dependence on at least one different parameter and for producing only positive jumps in the characteristic curve thereof, and valve slide means having different flow cross sections for producing by the displacement thereof the respectively desired control pressure.

13. An internal combustion engine according to claim 12, characterized in that the valve slide means is operable to selectively cover off several bores.

14. An internal combustion engine according to claim 12, characterized in that the valve slide means is provided with several bores of different cross section.

15. An internal combustion engine with applied ignition and fuel injection means for improving the exhaust gas emission during the warm-up phase of the engine, characterized by means for subdividing the warm-up phase of the engine into mutually independent nonnegative phases, said subdividing means including control means for discontinuously controlling the control pressure of the fuel injection means in dependence on at least one different parameter and for producing only positive jumps in the characteristic curve thereof, and throttle means for producing the positive jumps in the control pressure, said throttle means being provided as valve means having different graded steps.

16. An internal combustion engine according to claim 15, characterized in that the valve means is a cone valve.

17. An internal combustion engine according to claim 15, characterized in that the valve means is a pin valve.

18. An internal combustion engine according to claim 1, characterized in that at least one throttle means is provided operable to be selectively controlled in dependence on the corresponding parameter to produce the jump in the characteristic curve thereof, and in that a by-pass line is provided in parallel to the throttle means which by-pass line is operable to be selectively interconnected to by-pass the throttle means.

19. An internal combustion engine according to claim 1, characterized in that exclusively throttle means of different size are connected in series one behind the other to produce the respective jump in the characteristic curve.

20. An internal combustion engine according to claim 1, characterized in that a throttle means is provided to produce the jump in the characteristic curve, which is interconnected upstream of the warm-up controller means.

21. An internal combustion engine according to claim 1, characterized in that the control means includes means for adjusting different control pressure values independently of the base adjustment and the running-up period.

22. An internal combustion engine with a warm-up controller means according to claim 1, characterized in that a valve means is provided in the warm-up controller means to produce the jump in the characteristic curve, and in that a change of the valve stroke in the warm-up controller means is attained by external means.

23. An internal combustion engine according to claim 22, characterized in that the external means includes a solenoid.

* * * * *